United States Patent [19]

Van Norman

[11] Patent Number: 4,736,690

[45] Date of Patent: Apr. 12, 1988

[54] LIFTING TABLE TOP MECHANISM

[76] Inventor: Linn Van Norman, P.O. Box 6808, Colorado Springs, Colo. 80934

[21] Appl. No.: 912,577

[22] Filed: Sep. 29, 1986

[51] Int. Cl.[4] ..... A47B 3/00

[52] U.S. Cl. ..... 108/35; 312/208; 312/27

[58] Field of Search ..... 108/144, 35, 36; 312/24, 27, 208

[56] References Cited

U.S. PATENT DOCUMENTS

| | | | |
|---|---|---|---|
| Re. 28,835 | 6/1976 | Roberts | 312/208 |
| 78,250 | 5/1868 | Witney | 108/116 |
| 544,821 | 8/1895 | Morrison | 108/116 |
| 848,332 | 3/1907 | Westervelt | 108/147 |
| 1,689,445 | 10/1928 | Merriman | 108/106 |
| 1,965,370 | 7/1934 | Cohn | 312/24 |
| 2,630,359 | 3/1953 | Schade | 108/145 |
| 3,352,431 | 11/1967 | Smith | 108/145 |
| 3,614,184 | 10/1971 | Yawata | 312/27 |

FOREIGN PATENT DOCUMENTS

| | | | |
|---|---|---|---|
| 2721307 | 11/1978 | Fed. Rep. of Germany | 312/208 |
| 0516397 | 2/1955 | Italy | 312/27 |
| 141907 | 9/1953 | Sweden . | |
| 429063 | 1/1967 | Switzerland . | |

*Primary Examiner*—Kenneth J. Dorner
*Assistant Examiner*—Gerald A. Anderson
*Attorney, Agent, or Firm*—Linda Flewellen Gould

[57] ABSTRACT

A lifting table top mechanism is provided wherein a table top can be raised or lowered between two stable positions with respect to the table base, by means of moving a handle. The handle is incorporated into a rotating bar which is configured so that, when attached to the lower faces of a lower plate attached to the table base and one or two upper plates attached to the table top, movement of the handle causes the upper plates to be drawn toward or pushed away from the lower plate. A connecting bar, configured to be attached to the lower plate and upper plates, rotates in tandem with the rotating bar. A linear linking member links each end of the rotating bar to the corresponding end of the connecting bar. The upper plates are stablized in one of two positions: adjacent to the lower plate or at a maximum distance permitted by the configuration of the connecting bar and rotating bar. Such stabilization is achieved by an expansion spring mechanism and by the configuration of the connecting bar and rotating bar.

10 Claims, 4 Drawing Sheets

LIFTING TABLE TOP MECHANISM

DESCRIPTION

1. Technical Field

This invention pertains to a mechanism for lifting a table top to a stable, elevated position with respect to the base of the table. The same mechanism can be utilized to lower the table top to its original position with respect to the table base.

2. Background Art

A number of devices for moving a horizontal member between two positions are known in the prior art.

One such device is shown in U.S. Pat. No. 544,821 to Morrison wherein an arm rest includes an upper horizontal plate which is movable between raised and lowered positions relative to a lower plate or base. Linking members are attached to the side of both the upper and lower plates. A separate linking member is attached to the side of the upper plate, the opposite end of which is placeable into particular positions relative to teeth in a rack-bar attached to the side of the lower plate.

An ironing board which can be elevated from a position embedded in a table top is shown in U.S. Pat. No. 1,689,445 to Merriman. Linking members are attached at one end to the sides of verticle members extending from the lower face of the ironing board and, at the opposite end, to a verticle member encompassed in the table frame. A stabilizing member, with alternating positions corresponding to whether the ironing board is elevated or embedded in the table, is secured by a bolt.

Switzerland Pat. No. 429063 shows a table in which the table top can be moved between an elevated and lowered position. Two linear linking members are connected, at one end, to the bottom face of the table top, and at the other end, to an extension from the table base. One of the linking members is connected to a table leg by means of an extension spring.

U.S. Pat. No. 3,352,431 to Smith discloses an adjustable refrigerator shelf. The shelf is movable between two positions by rotating a rod supporting the shelf.

U.S. Pat. No. 848,332 to Westervelt discloses a baggage truck including a platform which is moveable between raised and lowered positions. Four linking members are attached, at one end, to the side of the upper platform, and at the other end, to a horizontal member which is embedded in the base of the truck.

A platform moveable between two positions with respect to a base is shown in Sweden Pat. No. 141907. The platform is raised by means of a handle. Two linking members, consisting of two linear pieces rotating around a connecting bolt, are connected, at one end, to the side of the platform, and at the other end, to the base. A rigid support member, connected to the platform at one end and the base at the other end, is hinged in the middle.

U.S. Pat. No. 2,630,359 to Schade discloses a vertically shiftable platform support for office furniture. Linking members are attached, at one end, to an extension from the lower face of the platform and, at the other end, to slide bars embedded in the base. A support member is attached, at one end, to one of the linking members, and at the other end, to a point on the slide bar.

U.S. Pat. No. 78,250 to Witney discloses an adjustable arm-rest. Linear linking members are attached to the upper face of a base, at one end, and to the lower face of the arm rest, at the other end. A linear support member, attached at one end to the lower face of the arm rest, is placeable into teeth of a rack embedded in the base.

Although each of these devices has been suitable for its intended purpose, none of them discloses a mechanism suitable to easily elevate a table top to a stable position to enable the arm rests on a wheelchair to fit under the table top. The invention disclosed herein contains features not revealed in the prior art, which enable a table top to be easily adjusted between two distinct heights, and stabilized in either a raised or lowered position.

DISCLOSURE OF THE INVENTION

The lifting table top mechanism of this invention comprises a device by which a table top may be moved between two distinct, stable positions with respect to the base of the table.

More specifically, the invention comprises four major elements. The first element comprises three rectangular members or plates, aligned so that the flat faces of the three plates are parallel to each other. Each of the three plates has a side A and a side B which are opposite and parallel to each other, a side C and a side D which are perpendicular to the side A and side B, and a top face and bottom face. The top faces and bottom faces of the three plates are aligned parallel to each other, while the side A of each plate is parallel to the side A of each other plate, the side B of each plate is parallel to the side B of each other plate, the side C of each plate is parallel to the side C of each other plate, and the side D of each plate is parallel to the side D of each other plate. The upper plates lie in a common plane and the lower plate lies in a plane spaced from the common plane of the two upper plates. The plates may be made of steel or other suitably rigid material. Two of the three plates are attached to the lower face of the table top or surface to be moved, while the third plate is attached to a base. Alternatively, the two upper plates may be replaced by a single plate, with a width equal to the distance between the opposite, outermost sides of the upper plates described herein. Although dual upper plates will be referred to herein, the description applies equally to the mechanism in which a single upper plate is utilized. The lower plate is positioned so that, when the table top and base are moved to the position in which they are closest together, a portion of the lower plate along two opposite sides adjoins and overlaps a portion of each of the upper plates. In this position, a portion of each of the upper plates extends beyond the corresponding sides of the lower plate, a distance sufficient to accommodate the spring mechanism described below.

The second major element comprises a means for connecting the upper plates to the lower plate. Said connecting means may consist of a round bar (the "connecting bar") extending across the lower face of the lower plate, parallel to two opposite sides of the lower plate. The first segment of the connecting bar, which extends across the lower plate, is attachable to the lower plate by a plurality of straps, pieces of angle iron, or other fittings, holding the connecting bar adjacent to the lower plate. Such fittings are connectable to the lower plate by welding or other means at points of attachment on either end of the fitting, in a manner which permits the connecting bar to be rotated within the fitting. The connecting bar extends, perpendicular to said first segment and in the direction toward the upper plates, beyond both edges of the sides of the lower plate which are perpendicular to said first segment. Such first extension segments are of a length equal to the maximum distance to be achieved between the table top and the table base. The connecting bar extends further, perpendicular to the first extension segment, so that the second extension segment on either end of the connecting bar is parallel to said first segment. These second extension segments are adjacent to the lower face of each of the upper plates, and extend toward the side of the upper plates which is perpendicular to the second extension segment and never adjacent to the lower plate. At the second extension segments, the connecting bar is attachable to each of the upper plates, by a means similar to the fittings by which said first segment is attached to the lower plate. A third extension segment of each end of the connecting bar, at a 90° angle to the second extension segment, lies in a plane with the second extension segments, which plane is parallel to the faces of the plates, when the plates are positioned so that the table top is in the elevated position with respect to the table base. In this way, each of the second and third extension segments of the connecting bar is adjacent to the lower face of the upper plates, when the table top is elevated, preventing the connecting bar from being rotated, in one direction, into a position which would move the upper plates closer to the lower plate.

The third element comprises a means for moving the upper plates between two positions, one position in which the upper plates are adjacent to the lower plate and one in which the upper plates are elevated with respect to the lower plate. Said moving means may consist of a round bar (the "rotating bar") to which a handle is attached. The rotating bar may be of the same configuration as the connecting bar, with a modification of the first segment to accommodate the attachment and movement of the handle. This modification is achievable by configuring the first segment of the rotating bar into five distinct sub-segments. The handle, a linear member which may consist of a round steel bar, is attachable perpendicular to the middle of the five sub-segments of the first segment, by welding or other means. The handle and all five sub-segments lie in a plane which is parallel and adjacent to the lower face of the lower plate, when the lower plate is in the position adjacent to the upper plates. The outermost two sub-segments of the first segment are attachable to the lower face of the lower plate in a manner similar to the means by which the first segment of the connecting bar is attached to the lower plate. Similarly, the segments of the rotating bar adjacent to the upper plates are attachable to the lower faces of the upper plates in a manner similar to the means by which the connecting bar is attached to the upper plates. The middle sub-segment and outermost sub-segments of the first segment of the rotating bar are configured parallel to each other, while the remaining two sub-segments are perpendicular to the middle and outermost sub-segments.

The fourth element comprises a spring mechanism. Four linear members, such as rivets, are attachable, by welding or other means, to the lower face of the lower plate, extending across and perpendicular to the sides of the lower plate which are perpendicular to the first segments. These linear members are arranged so that an expansion spring may be attached to each one, and thence drawn to a rivet or other linear member attached, at a 90° angle, to an end of the connecting bar or rotating bar, in such a manner and position that the spring exerts pressure to stabilize both the position in which the upper plates are adjacent to the lower plate, and the position in which the upper plates are at the maximum distance from the lower plate. The rivet attached to the end of each connecting bar is linked, by means of a linear linking member, to the rivet attached to the end of the rotating bar touching the same upper plate. This linear linking member is attached so as to allow each rivet to rotate, while maintaining an unchanging distance between the connecting bar and rotating bar, so that the connecting bar rotates to the same angle as the rotating bar.

The lifting table top mechanism is designed so as to provide for the top of a table or other surface, attached to the upper plates, to be elevated from the table base, by moving the handle so as to rotate the rotating bar. Thus, a table top may be easily elevated, by rotating the handle incorporated in the rotating bar, to a stable position sufficiently high to fit the arm rests of a wheelchair under the table top. The table top may also be lowered, again by moving the handle, to its normal stable height.

Additional advantages of this invention will become apparent from the description which follows, taken in conjunction with the accompanying drawings.

BEST MODE FOR CARRYING OUT THE INVENTION

Figure 1:
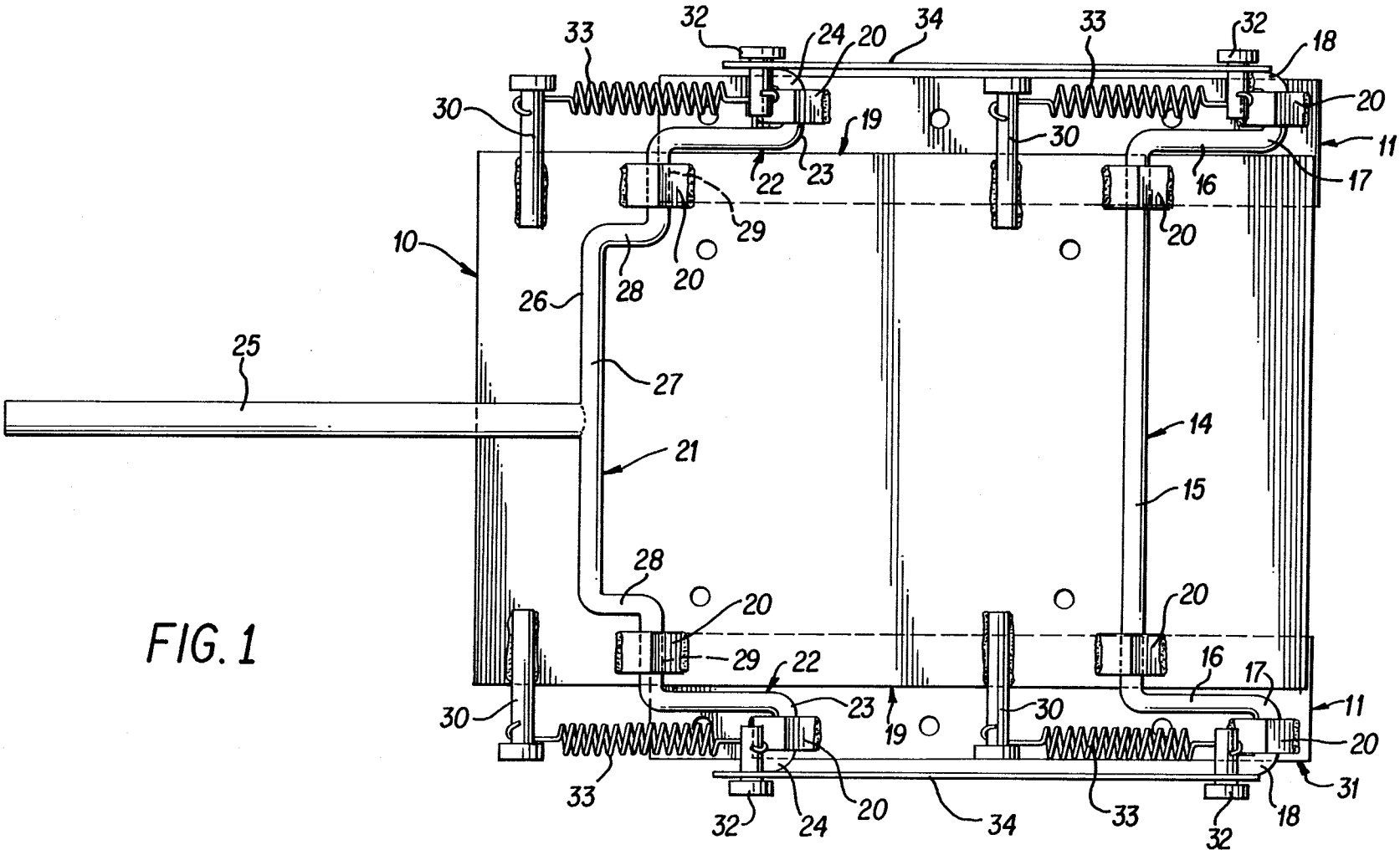
FIG. 1 is a bottom view of the lifting table top mechanism, in the position in which the upper plates are adjacent to the lower plate.
Figure 3:
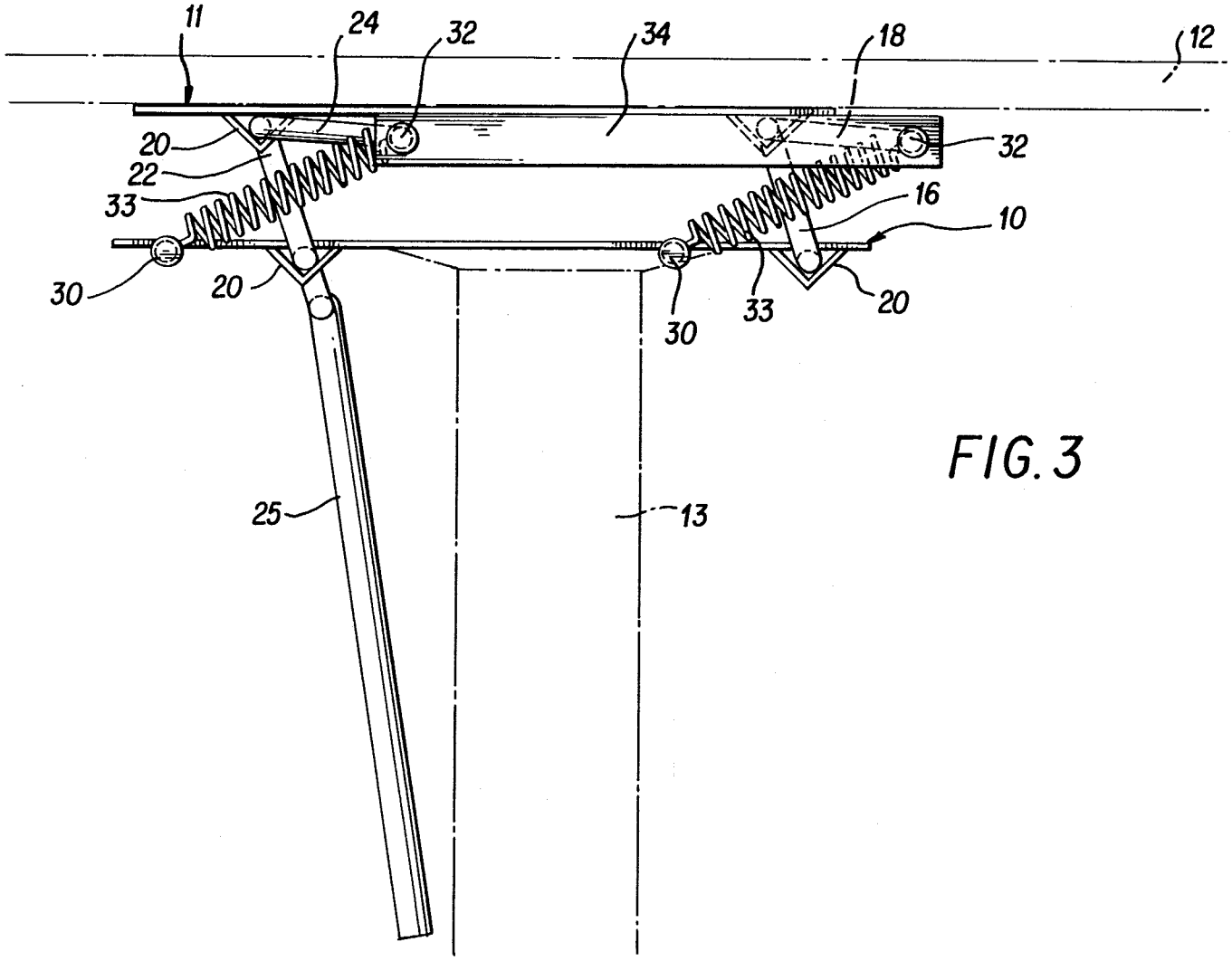
FIG. 3 is a side view of the mechanism, in the position in which the upper plates are elevated with respect to the lower plate, and indicating the position of a table top and table base attachable to the mechanism.
Figure 4:
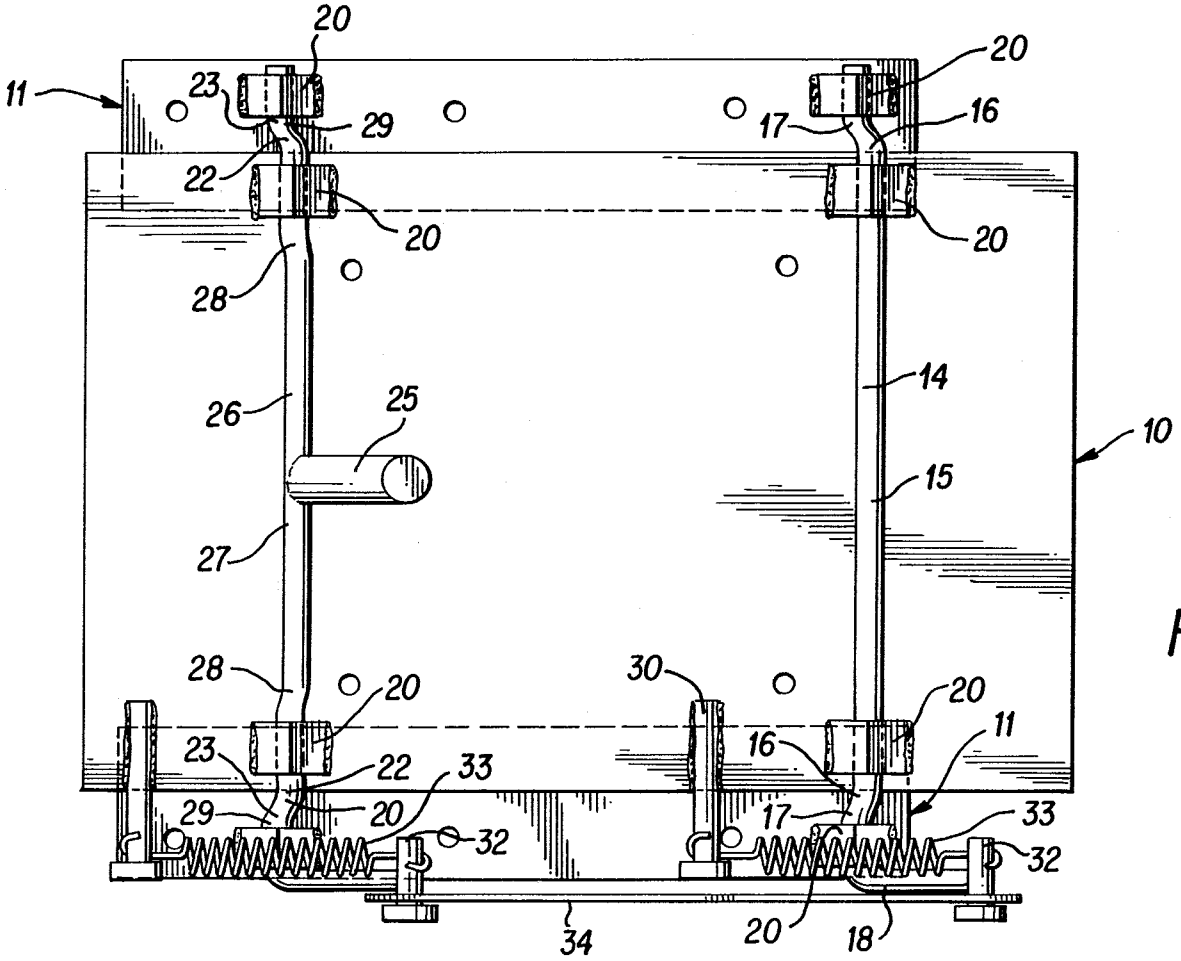
FIG. 4 is a bottom view, in the position in which the upper plates are elevated with respect to the lower plate.

In accordance with this invention, a mechanism is provided in which a lower plate 10 is aligned parallel to two upper plates 11. As shown in FIG. 3, a table top 12 or other surface is attachable to the upper faces of the upper plates 11, while a table base 13 is attachable to the lower face of the lower plate 10. Conveniently, each upper plate 11 is positioned so that when the upper plates 11 are adjacent to the lower plate 10, a portion of the lower plate 10 along each of the opposite sides 19 adjoins and overlaps a portion of each of the upper plates 11, as best shown in FIG. 1. Alternatively, the upper plates 11 may be replaced by a single upper plate, with width equal to the distance between the opposite outermost sides 31 of the upper plates 11. The upper plates 11 are connected to the lower plate 10 by a connecting bar 14 comprising an first segment 15, first extension segments 16, second extension segments 17 and third extension segments 18 in the configuration shown in FIG. 1. This configuration permits the second and third extension segments 17, 18 to arrest the movement of the upper plates 11, stabilizing the upper plates 11 in the position in which the upper plates 11 are separated from the lower plate 10 a distance equal to the length of the first extension segments 16. The connecting bar 14 is attached to the lower plate 10 and upper plate 11 by a plurality of fittings 20, in a manner which permits the connecting bar 14 to be rotated within the fittings 20.

Conveniently, a rotating bar 21 is configured and positioned so that each of the extension segments 22, 23, 24 are parallel to the corresponding extension segments 16, 17, 18 of the connecting bar 14. A handle 25 is attached to the rotating bar 21 at the middle sub-segment 26 of the first segment 27 of the rotating bar 21. The first segment 27 is configured so that the middle sub-segment 26 is separated from the lower face of the lower plate 10 by the length of the sub-segment 28. The subsegment 28 of the first segment 27 is perpendicular to the middle sub-segment 26 and the outermost sub-segments 29. The outermost sub-segments 29 are attached to the lower face of the lower plate by fittings 20.

Figure 2:
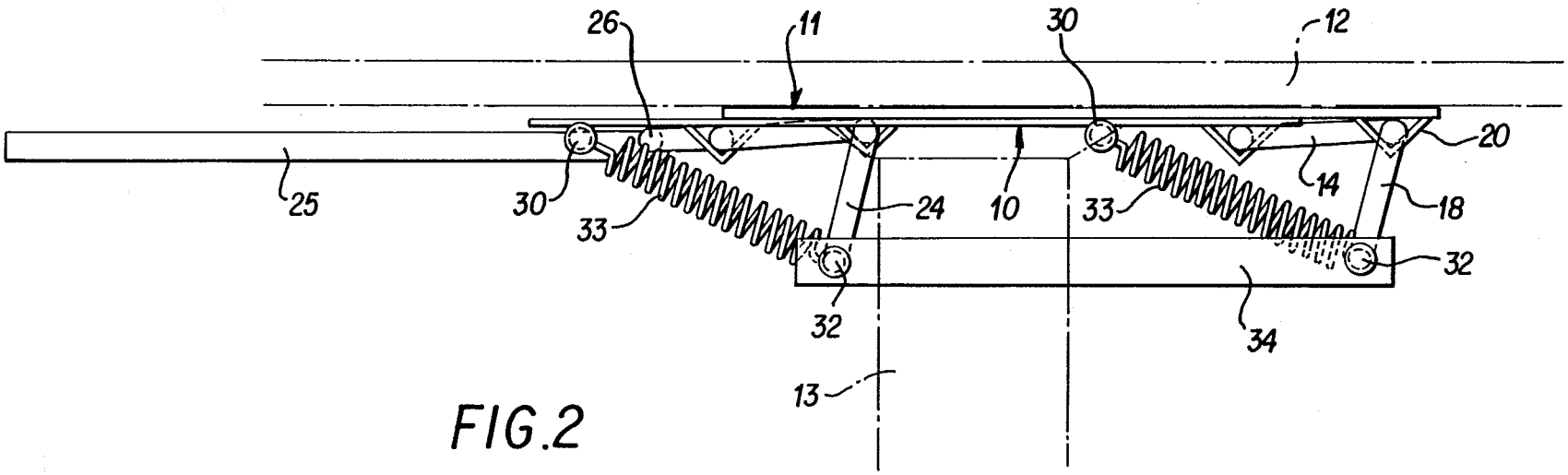
FIG. 2 is a side view of the mechanism, in the position in which the upper plates are adjacent to to the lower plate, indicating the position of a table top and base attachable to the mechanism.

Four linear members 30 are attached to the lower face of the lower plate 10, perpendicular to the sides 19 of the lower plate 10. Similar linear members 32 are attached to the end of each third extension segment 18, 24. An expansion spring 33 is drawn between each linear member 30 and the linear member 32 closest to that respective linear member 30. In this way, the expansion spring 33 exerts pressure to stabilize the mechanism in either the elevated position shown in FIG. 3 or the position shown in FIG. 2.

A linear linking member 34 is attached to linear members 32, in a member which allows the linear members 32 to rotate freely, so that one end of the bracing member 34 is connected to a linear member 32 attached to the connecting bar 14, and the other end of the bracing member 34 is connected to a linear member 32 attached to the rotating bar 21. By this design, the connecting bar is forced to move in tandem with the rotating bar.

Based on the foregoing description, a number of worthwhile advantages of the present invention are readily apparent. A mechanism has been provided whereby a table top may be elevated with respect to the table base by simply rotating a handle about an axis comprising the outermost sub-segments of the first segment of the rotating bar. Stabilizing influences, in the form of the second and third extension segments of the connecting bar and rotating bar, and in the form of expansion springs, insure that the table top will not move into the position adjacent to the table base, until the handle is rotated in the opposite direction. Thus, the table top can be simply elevated to a stable position, enabling a wheelchair to be positioned at the table, with the arm rests of the wheelchair fitting under the elevated table top. Similarly, the table top can be easily moved to its normal position adjacent to the table base, by moving the handle, in which position the expansion springs again provide stabilization.

The invention has been described in detail with particular reference to preferred embodiments thereof, but it will be understood that variations and modifications can be effected within the spirit and scope of the invention.

I claim:

1. A lifting table top mechanism, operative between a base and a bottom face of a table top or other surface to enable the table top to be moved relative to the base between a first stabilized elevation and a second stabilized elevation spaced a predetermined distance from the first elevation, said mechanism comprising:

(a) three rectangular members or plates, each plate having a side A and a side B which are opposite and parallel to each other, a side C and a side D which are perpendicular to the side A and side B, and a top face and bottom face, the top faces and bottom faces of the three plates being aligned parallel to each other, the side A of each plate being parallel to the side A of each other plate, the side B of each plate being parallel to the side B of each other plate, the side C of each plate being parallel to the side C of each other plate, and the side D of each plate being parallel to the side D of each other plate, the two upper plates lying in a common plane and a lower plate lying in a plane spaced from the common plane of the two upper plates;

(b) means for attaching the lower plate to the base;

(c) means for attaching the two upper plates to the bottom face of the table top in a position wherein portions of the lower plate which are adjacent to its sides A and B adjoin and overlap portions of each of the upper plates adjacent to each of their sides A and B, when the table top and base are moved to the first stabilized elevation;

(d) a connecting bar pivotably attached to the bottom face of the lower plate and to the bottom faces of the upper plates, said connecting bar comprising a plurality of connected segments having the following characteristics:

(i) a first segment pivotably attached to the bottom face of the lower plate and extending adjacent to the bottom face of the lower plate and parallel to the sides C and D of the lower plate;

(ii) a pair of first equal length extension segments, each first extension segment connected at an opposite end of said first segment, each first extension segment extending in a direction toward the upper plates and perpendicular to said first segment at a position beyond sides A and B, of the lower plate, the length of each first extension segment is equal to the maximum predetermined distance between the first and second stabilized elevations;

(iii) a pair of second extension segments, each of which is connected to one first extension segment, each second extension segment is pivotably attached to the bottom face of a different one of the upper plates, each second extension segment extends perpendicular to the first extension segment to which it is connected and parallel to said first segment, toward the sides A and B, respectively, of the upper plates; and (iv) a pair of third extension segments, each of which is connected to one second extension segment and which extends perpendicular to the second extension segment to which it is connected, each connected second and third extension segment lie in a plane which is parallel to the top and bottom faces of the lower plate when the table top is in the second stabilized elevation;

(e) a rotating bar pivotably attached to the bottom face of the lower plate and the bottom faces of the upper plates, to move the upper plates toward and away from the lower plate to achieve movement to and from the first and second stabilized elevations, said rotating bar comprising a plurality of connected segments having the following characteristics:

(i) a first section attached to the bottom face of the lower plate, and extending adjacent to the bottom face of the lower plate and parallel to the first segment of the connecting bar;

(ii) a pair of first equal length extension sections each first extension section connected at an opposite end of said first section, each first extension section extends parallel to and moves in that plane in which the first extension segments of the connecting bar move, each first extension section has a length equal to the length of each of the first extension segments of the connecting bar;

(iii) a pair of second extension sections, each of which is connected to one first extension section, each second extension section is pivotably attached to the bottom face of one of the upper plates, each second extension section extends parallel to and in a plane with the other second extension section and both second extension segments of the connecting bar, each second extension section is equal to the length of each of the second extension segments of the connection bar;

(iv) a pair of third extension sections, each third extension section is connected to one second extension section and extends parallel to and moves in that plane in which the third extension segments of the connecting bar move; and (v) a handle member, attached to said first section to pivot the rotating bar around an axis through the first section to move the table top between the first and second stabilized elevations;

(f) fitting means for pivotably attaching the connecting bar and the rotating bar to the bottom face of the lower plate and the bottom faces of the upper plates;

(g) expansion spring means stabilizing the upper plates in each of the positions wherein the table top is in the first or second stabilized elevation; and (h) linking means connected to the connecting bar and the rotating bar causing the connecting bar to move in tandem with the rotating bar.

2. A lifting table top mechanism operative between a base and a bottom face of a table top or other surface to enable the table top to be moved relative to the base between a first stabilized elevation and a second stabilized elevation spaced a predetermined distance from the first elevation, said mechanism comprising:

(a) three rectangular members or plates, each plate having a side A and a side B which are opposite and parallel to each other, a side C and a side D which are perpendicular to the side A and side B, and a top face and bottom face, the top faces and bottom faces of the three plates being aligned parallel to each other, the side A of each plate being parallel to the side A of each other plate, the side B of each plate being parallel to the side B of each other plate, the side C of each plate being parallel to the side C of each other plate, and the side D of each plate being parallel to the side D of each other plate, the two upper plates lying in a common plane and a lower plate lying in a plane spaced from the common plane of the two upper plates;

(b) means for attaching the lower plate to the base;

(c) means for attaching the two upper plates to the bottom face of the table top in a position wherein portions of the lower plate which are adjacent to its sides A and B adjoin and overlap portions of each of the upper plates adjacent to each of their sides A and B, when the table top and base are moved to the first stabilized elevation;

(d) a connecting bar pivotably attached to the bottom face of the lower plate and to the bottom faces of the upper plates, said connecting bar comprising a plurality of connected segments having the following characteristics:

(i) a first segment pivotably attached to the bottom face of the lower plate and extending adjacent to the bottom face of the lower plate and parallel to the sides C and D of the lower plate;

(ii) a pair of first equal length extension segments, each first extension segment connected at an opposite end of said first segment, each first extension segment extending in a direction toward the upper plates and perpendicular to said first segment at a position beyond sides A and B, of the lower plate, the length of each first extension segment is equal to the maximum predetermined distance between the first and second stabilized elevations;

(iii) a pair of second extension segments, each of which is connected to one first extension segment, each second extension segment is pivotably attached to the bottom face of a different one of the upper plates, each second extension segment extends perpendicular to the first extension segment to which it is connected and parallel to said first segment, toward the sides A and B, respectively, of the upper plates; and (iv) a pair of third extension segments, each of which is connected to one second extension segment and which extends perpendicular to the second extension segment to which it is connected, each connected second and third extension segment lie in a plane which is parallel to the top and bottom faces of the lower plate when the table top is in the second stabilized elevation;

(e) a rotating bar pivotably attached to the bottom face of the lower plate and the bottom faces of the upper plates, to move the upper plates toward and away from the lower plate to achieve movement to and from the first and second stabilized elevations, said rotating bar comprising a plurality of connected segments having the following characteristics:

(i) a first section attached to the bottom face of the lower plate, and extending adjacent to the bottom face of the lower plate and parallel to the first segment of the connecting bar, said first section comprising five connected sub-sections, all of which sub-sections lie in a plane parallel and adjacent to the bottom face of the lower plate when the table top is in the first stabilized elevation, the outermost sub-sections being parallel to the middle sub-section, and to the first segment of the connecting bar, and the two remaining interior sub-sections being perpendicular to the middle sub-section of the first section;

(ii) a pair of first equal length extension sections each first extension section connected at an opposite end of said first section, each first extension section extends parallel to and moves in that plane in which the first extension segments of the connecting bar move, each first extension section has a length equal to the length of each of the first extension segments of the connecting bar;

(iii) a pair of second extension sections, each of which is connected to one first extension section, each second extension section is pivotably attached to the bottom face of one of the upper plates, each second extension section extends parallel to and in a plane with the other second extension section and both second extension segments of the connecting bar, each second extension section is equal to the length of each of the second extension segments of the connection bar;

(iv) a pair of third extension sections, each third extension section is connected to one second extension section and extends parallel to and moves in that plane in which the third extension segments of the connecting bar move; and (v) a handle member, lying in a plane parallel and adjacent to the bottom face of the lower plate when the table top is in the first stabilized elevation, the handle being attached perpendicular to the middle sub-section of the first section, to pivot the rotating bar around an axis through the outermost subsections of the first section to move the table top between the first and second stabilized elevations;

(f) fitting means for pivotably attaching the connecting bar and the rotating bar to the bottom face of the lower plate and the bottom faces of the upper plates;

(g) expansion spring means stabilizing the upper plates in each of the positions wherein the table top is in the first or second stabilized elevation; and (h) linking means connected to the connecting bar and the rotating bar causing the connecting bar to move in tandem with the rotating bar.

3. A lifting table top mechanism as claimed in claim 2, wherein:

said expansion spring means comprises four linear rivet members attached to the bottom face of the lower plate, perpendicular to and extending across the sides A and B of the lower plate; four other linear rivet members attached to the end of each third extension segment of the connecting bar and each third extension section of the rotating bar, perpendicular to said third extension segments and third extension sections; and said expansion spring means comprises four expansion springs, each expansion spring is attached at one end to a linear rivet member attached to the lower plate and is attached at the other end to a linear rivet member on an end of the rotating bar or connecting bar.

4. A lifting table top mechanism as claimed in claim 3, wherein:

said linking means comprises a linear linking member attached, at one end, to a linear rivet member attached to the end of the rotating bar, and at the other end, to a linear rivet member attached to the end of the connecting bar on the same side of the lower plate, in a manner which allows each linear rivet member to rotate, while maintaining an unchanging distance between the connecting bar and rotating bar, so that the connecting bar rotates to the same degree as the rotating bar.

5. A lifting table top mechanism as claimed in claim 2, wherein:

said fitting means comprises a plurality of bar straps holding each first segment of the connecting bar and each first section of the rotating bar to the bottom face of the lower plate and holding each second extension segment of the connecting bar and each second extension section of the rotating bar to the bottom faces of the upper plates, each bar strap being attached to a face of one plate.

6. A lifting table top mechanism as claimed in claim 2, wherein:

said fitting means comprises a plurality of sections of angle iron holding each first segment of the connecting bar and each first section of the rotating bar to the bottom face of the lower plate, and holding each second extension segment of the connecting bar and second extension section of the rotating bar to the bottom faces of the upper plates, each section of angle iron being attached to a face of one plate.

7. A lifting table top mechanism as claimed in claim 2, wherein:

said fitting means comprises a plurality of elements, each element being either a section of angle iron or a bar strap, so that either a bar strap or section of angle iron, or a combination of both holds each first segment of the connecting bar and each first section of the rotating bar to the bottom face of the lower plate, and holds each second extension segment of the connecting bar and each second extension section of the rotating bar to the bottom faces of the upper plates, each section of angle iron and each bar strap being attached to a face of one plate.

8. A lifting table top mechanism as claimed in claim 2, wherein:

said upper plates are parts of a single upper plate, which has a width equal to the distance between the side A of one of the upper plates and the side B of the other upper plate which sides are furthest spaced from each other.

9. A lifting table top mechanism as claimed in claim 2, wherein:

said lower plate is comprised of two separate plates, aligned so that the flat faces of said separate plates are in a common plane and parallel to each other and the corresponding sides of the separate plates are parallel to each other, each of which separate plates is attached:

(a) on its bottom face, to a common base, and (b) on its top face, to the second extension segment of the connecting bar and the second extension section of the rotating bar.

10. A lifting table top mechanism as claimed in claim 2, wherein:

said expansion spring means comprises two linear rivet members attached to the bottom face of the lower plate, perpendicular to and extending across the side A of the lower plate; another linear rivet member attached to the end of a third extension segment of the connecting bar perpendicular to and extending across the side A of one upper plate, and another linear rivet member attached to the end of a third extension section of the rotating bar on the side A of one upper plate; and two expansion springs, each spring attached at one end to a linear rivet member attached to the lower plate, and attached at the other end to a linear rivet member on the end of the rotating bar or connecting bar.

* * * * *